US005295614A

United States Patent [19]

Chang

[11] Patent Number: 5,295,614

[45] Date of Patent: Mar. 22, 1994

[54] DOUBLE REDUCTION GEAR FOR DISPENSING GUN

[76] Inventor: Peter J. Y. Chang, 11001 Petersborough Dr., Rockville, Md. 20852

[21] Appl. No.: 994,936

[22] Filed: Dec. 22, 1992

[51] Int. Cl.[5] ..... B67D 5/52

[52] U.S. Cl. ..... 222/137; 222/391

[58] Field of Search ..... 222/135-137, 222/145, 333, 391, 325-327; 192/93 R; 74/89, 17, 89.16, 89.11; 401/66

[56] References Cited

U.S. PATENT DOCUMENTS

| | | | |
|---|---|---|---|
| 3,161,323 | 12/1964 | Bent | 222/391 X |
| 3,491,919 | 1/1970 | Ramsay | 222/391 X |
| 3,568,885 | 3/1971 | Spencer | 222/137 X |
| 3,687,339 | 8/1972 | Dessureault | 222/183 |
| 3,774,819 | 11/1973 | Bratton | 222/391 |
| 3,861,567 | 1/1975 | Davis, Jr. | 222/333 |
| 4,260,076 | 4/1981 | Bergman | 222/333 X |
| 4,264,021 | 4/1981 | Davis, Jr. | 222/326 |
| 4,273,269 | 6/1981 | Davis, Jr. | 222/326 |
| 4,452,285 | 6/1984 | Leibhard et al. | 222/136 X |
| 4,583,934 | 4/1986 | Hata et al. | 425/376 R |
| 4,669,636 | 6/1987 | Miyata | 222/391 X |
| 4,781,482 | 11/1988 | Ursprung | 401/1 |
| 4,986,454 | 1/1991 | Riley | 222/327 |
| 4,998,648 | 3/1991 | Contreras | 222/370 |
| 5,058,781 | 10/1991 | Aronie et al. | 222/333 X |
| 5,236,105 | 8/1993 | Galex | 222/327 X |

FOREIGN PATENT DOCUMENTS

| | | |
|---|---|---|
| 1049551 | 1/1959 | Fed. Rep. of Germany . |
| 3418052 | 12/1984 | Fed. Rep. of Germany . |
| 3812157 | 9/1989 | Fed. Rep. of Germany . |

*Primary Examiner*—Andres Kashnikow
*Assistant Examiner*—Kenneth DeRosa
*Attorney, Agent, or Firm*—Leonard Bloom

[57] ABSTRACT

A completely portable trigger-operated dispensing gun which employs a simple and reliable double reduction gear system for driving one or more axial plungers with an extreme dispensing force, said force being sufficient for dispensing highly viscous materials such as epoxy resin and hardener from a conventional twin cylinder epoxy cartridge having an elongate mixing nozzle.

25 Claims, 6 Drawing Sheets

DOUBLE REDUCTION GEAR FOR DISPENSING GUN

BACKGROUND OF THE INVENTION

1. Field of the Invention

The present invention relates to dispensing guns for fluid materials and, more particularly, to a dispensing gun incorporating a double reduction gear for extruding highly viscous materials.

2. Description of the Prior Art

Dispensing guns for highly viscous materials must generate extreme amounts of pressure to the material. This is especially true of conventional industrial epoxy guns. Such guns typically accept twin cylinder cartridges which separately contain the epoxy bonding agent and resin. The gun is operated to drive the bonding agent and resin to one end of the cartridge where the materials are combined and are extruded outward through an extended nozzle. In commercial applications, the nozzle typically comprises a thin tube with an interior arrangement of foils to provide a convoluted, internal passageway for the combined materials. As the epoxy materials are forced through the convoluted nozzle, the foils ensure that the resin and bonding agent are properly mixed before being ejected. However, the pressure needed to drive the epoxy materials through the convoluted nozzle is extreme.

For this reason, the prior art epoxy dispensing guns inevitably employ a motorized or pneumatic drive system.

For example, U.S. Pat. No. 4,583,934 issued to Hata et al. shows a rack and pinion type electric drive system for extruding fluid material from a nozzle 11. The rack and pinion assembly employs a reduction type gear assembly for increasing torque derived from the electric motor.

Similarly, U.S. Pat. No. 4,669,636 issued to Miyata shows an electric dispensing gun which employs a motor and clutch for selectively driving a rack and pinion type piston assembly.

Various pneumatic counterparts are also known to exist.

Unfortunately, electric guns often cannot be operated in the field without a portable generator. Pneumatic guns cannot be operated without a compressor. The guns themselves necessarily incorporate costly precision pneumatic or electrical parts which are inordinately expensive to manufacture. Such constraints render the guns completely useless for many field applications and expensive and impractical for others.

Clearly, there would be great advantages in a manually operated dispensing gun which is capable of developing sufficient force to dispense highly viscous materials such as, for instance, epoxy materials from a conventional twin cylinder epoxy cartridge.

SUMMARY OF THE INVENTION

Accordingly, it is an object of the present invention to provide an industrial grade, hand-operated dispensing gun which generates sufficient force for dispensing epoxy materials through a conventional twin cylinder epoxy cartridge (with elongate mixing nozzle).

It is another object of the present invention to provide a completely portable, hand-operated epoxy dispensing gun which eliminates the need for compressors or generators.

It is a further object of the present invention to incorporate a double reduction gear system in a trigger-operated dispensing gun for driving an axial plunger (two plungers in the case of a twin cylinder gun) with an extreme dispensing force.

It is still another object to provide a double reduction gear drive as described above which is strong, durable, reliable, and economical to manufacture.

According to the present invention, the above-described and other objects are accomplished by providing a double-reduction drive assembly for a dispensing gun. The drive assembly generally includes a housing, an elongate plunger traversing the housing, a trigger connected to the housing for driving the plunger, and a double-reduction gear assembly carried in the housing for mechanically converting manual contractions of the trigger into incremental axial movement of the plunger.

The plunger is formed with a toothed rack along its length.

The reduction gear assembly further comprises a spur gear coupled to the trigger and rotatable therewith, a larger main drive gear rotatably carried in the housing and engagable with the spur gear, and a smaller pinion gear carried in the housing alongside the main drive gear and engagable with the toothed rack of the plunger for driving the plunger.

In operation, each manual contraction of the trigger serves to rotate the spur gear, which engages and rotates the main drive gear, thereby rotating the pinion gear, which in turn advances the plunger in axial increments.

The invention also encompasses a twin-cylinder embodiment which employs dual plunger shafts driven by separate coaxial pinion gears.

A quick-release camming assembly is also provided for conveniently biasing the main drive gear out of engagement with the spur gear, while simultaneously disengaging the pinion gear(s) from the plunger shaft(s), thereby allowing retraction of the plunger shaft(s) and replacement of a spent cartridge.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENTS

Figure 1:
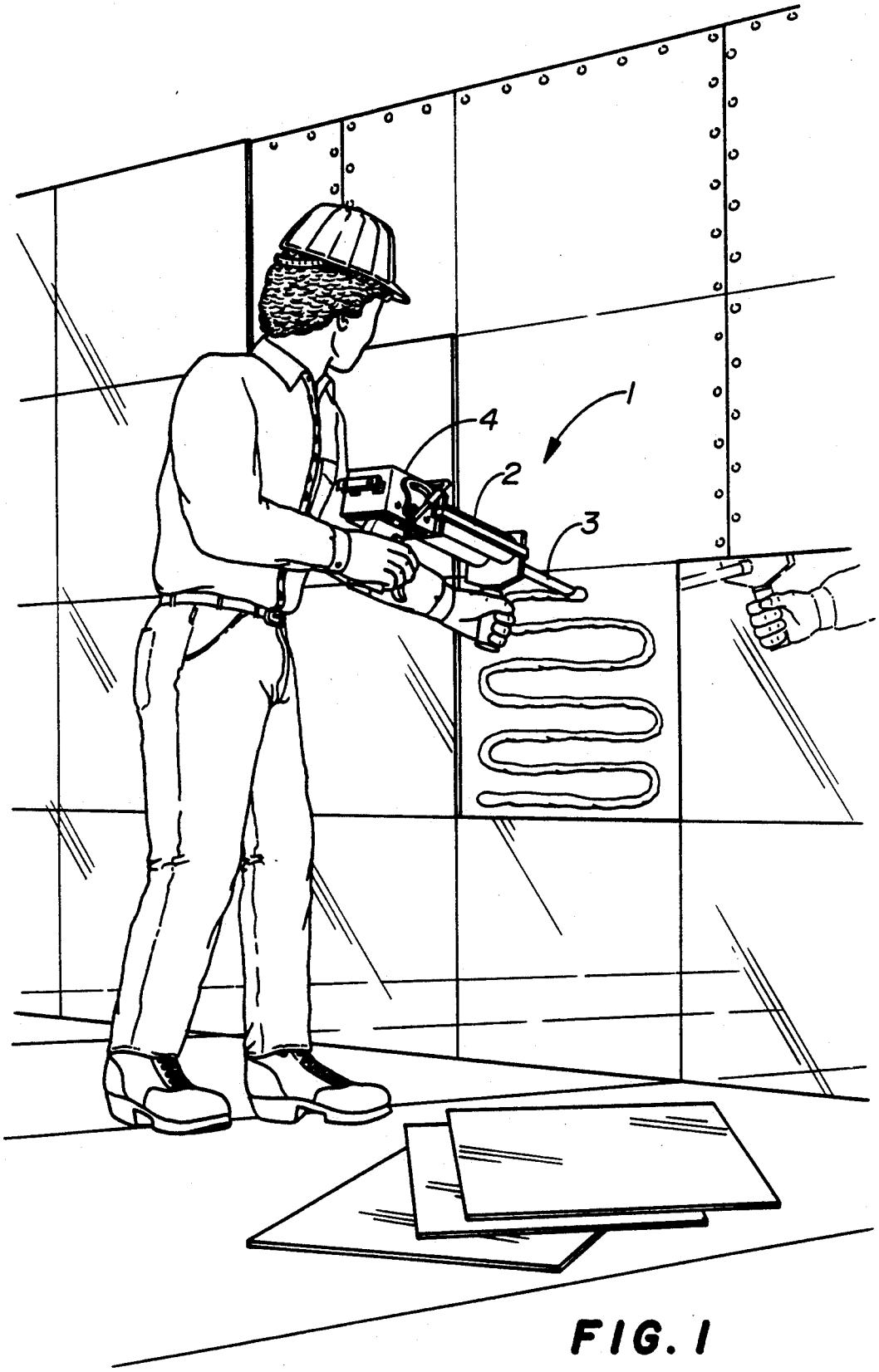
FIG. 1 is a perspective view illustrating the manner of using an industrial twin-cylinder epoxy gun incorporating a double reduction gear drive and quick release assembly according to the present invention.

FIG. 1 is a perspective view illustrating the manner of using an industrial twin-cylinder epoxy gun 1 incorporating a double reduction gear drive and quick release assembly according to one embodiment of the present invention. The gun generally includes a support structure 2 for seating a conventional twin cylinder epoxy cartridge. The mixing nozzle 3 of the twin cylinder epoxy cartridge protrudes forwardly from the support structure 2, and a reduction drive assembly 4 with quick release feature according to the present invention is integrally attached rearwardly of support structure 2. Trigger operation of the drive assembly 4 urges a dual plunger internally through the twin cylinder epoxy cartridge to thereby dispense the epoxy materials. The epoxy resin and hardener are combined and mixed in nozzle 3 just prior to dispensation.

Figure 2:
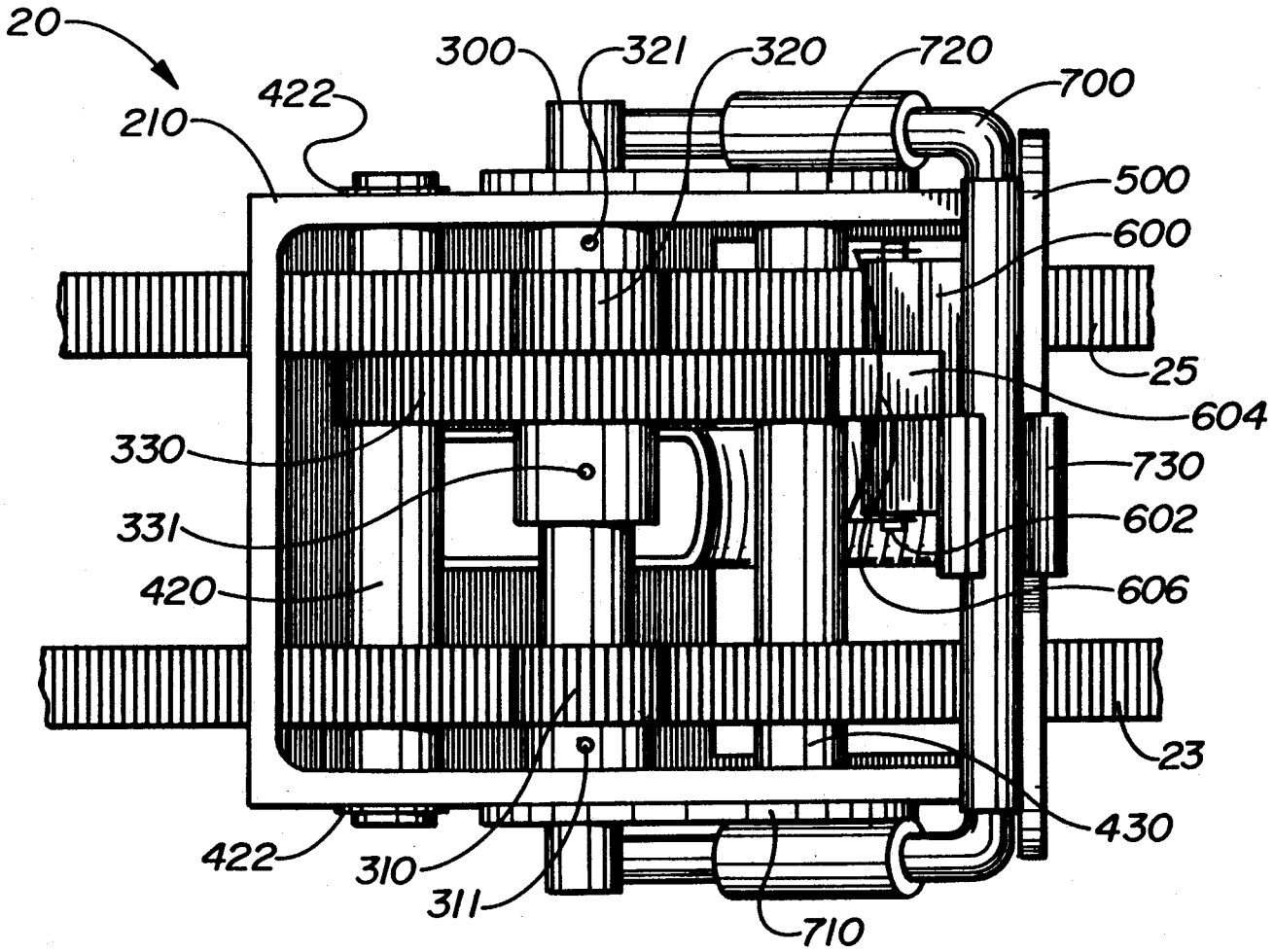
FIG. 2 is a top view of the double reduction gear drive with quick release assembly according to the present invention.
Figure 3:
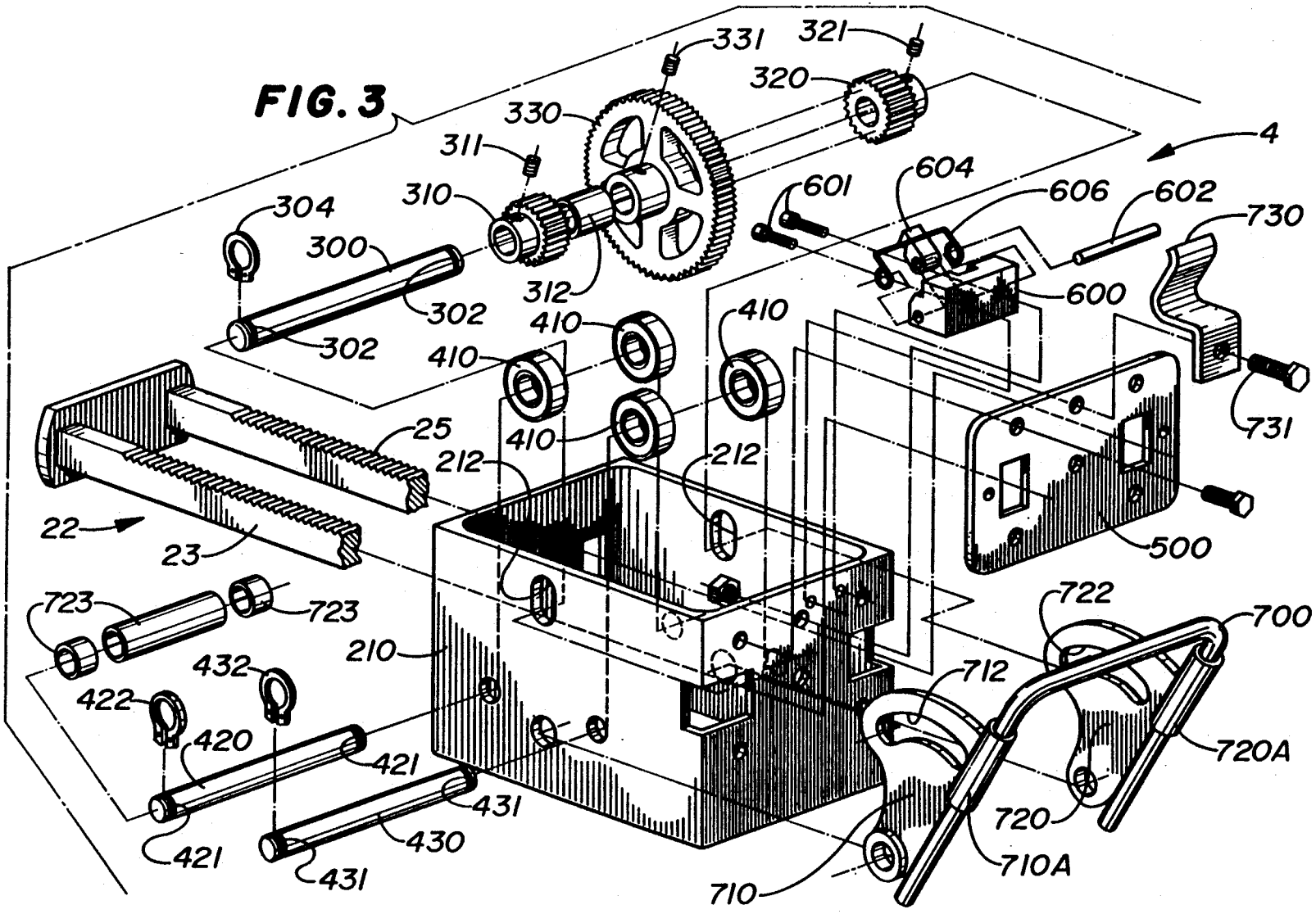
FIG. 3 is a partial exploded view of the double reduction gear drive with quick release assembly as in FIG. 2.
Figure 4:
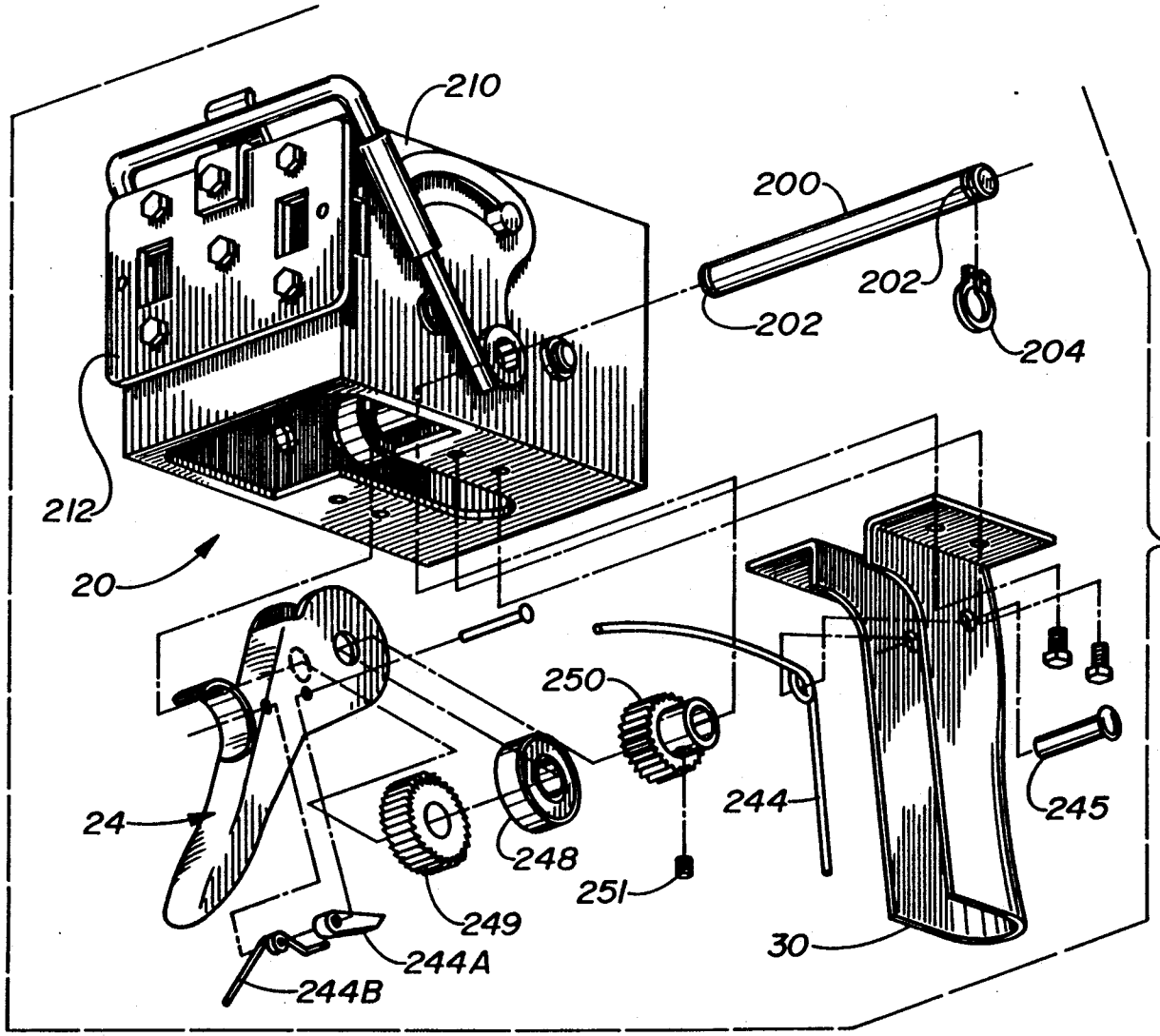
FIG. 4 is a partial exploded view to be viewed in conjunction with FIG. 3.

The detailed design of the drive assembly 4 with quick release feature will now be described with reference to FIGS. 2–4, wherein FIG. 2 is a top view, and FIGS. 3 and 4 are exploded views of the reduction drive assembly 4 of FIG. 1.

The drive assembly 4 of the present invention includes cooperating double reduction gears which operatively drive dual plunger 22 (having shafts 23 and 25) to invade a twin cylinder epoxy cartridge (not shown), thereby extruding epoxy compound.

The drive assembly 4 includes a housing 210 which contains the double-reduction gears. A handle 30 is secured to the underside of housing 210 and extends downwardly therefrom. A trigger 24 extends downwardly from the housing 210 proximate handle 30, and trigger 24 may be manually contracted as many times as desirable to expel a desired amount of epoxy material. Each incremental contraction of trigger 24 against handle 30 operates to drive the dual plunger 22 by axial increments.

The double reduction drive assembly 4 introduces two levels of geared torque augmentation so that the axial driving force of dual plunger 22 far exceeds the manual force necessary to contract trigger 24 against handle 30.

Housing 210 may be rectangular with opposing side-walls, front and rear walls, and a partial bottom wall. Housing 210 encloses and seats the cooperating double-reduction gears in the following manner.

As seen in FIG. 4, trigger 24 is pivotably mounted on a trigger axle 200 and protrudes downwardly therefrom through an opening in the bottom wall of housing 210. Trigger axle 200 is inserted through housing 210 and is supported by the side-walls thereof. Trigger axle 200 may be formed as illustrated with annular grooves 202 around the opposing ends. The length of trigger axle 200 should slightly exceed the spacing between the side-walls of housing 210. This way, locking C-rings 204 may be inserted in the respective grooves 202 exteriorly of the side-walls to anchor trigger axle 200 within the housing 210. The downward opening in the bottom wall of housing 210 should be sufficient to afford trigger 24 a clearance so that it may be pivoted against handle 30.

Trigger 24 is a generally recessed member with two opposing sides bounding a central hollow. A uni-directional bearing 248 is press fit into a ratchet gear 249, and the press-fit assembly is mounted within the hollow of trigger 24 to permit one-way rotation of trigger axle 200 in accordance with the contractions of trigger 24. If the pressure in the epoxy cartridge becomes excessive the uni-directional bearing 248 may slip. A dog assembly 244A and 244B is provided for this circumstance. Dog 244A is mounted on a central pivot which is offset from the trigger axle 200, and a spring 244B is also mounted on the pivot to ensure that dog 244A remains engaged in ratchet gear 249.

In operation, trigger 24 is contracted against handle 30 and the internal clutch of uni-directional bearing 248 engages, thereby forcing trigger axle 200 to rotate counterclockwise. If the pressure in the epoxy cartridge becomes excessive the uni-directional bearing 248 may begin to slip during contraction of trigger 24. In this case, dog 244A engages the ratchet gear 249 and continues rotation of the trigger axle 200.

As trigger 24 is released, the internal clutch of uni-directional bearing 248 disengages. Both the uni-directional bearing 248 and dog 244A allow the trigger to return to its forward position without any corresponding rotation of ratchet gear 249. Reverse rotation of the main drive gear 300 is prevented by dog 604.

A coiled spring 244 is provided within the hollow of handle 30 to return trigger 24 to its original position. The coil(s) of spring 244 are preferably attached within handle 30 by, for example, a transverse rivet 245 or the like. Spring 244 is coiled around rivet 245, and one elongate leg of spring 244 extends downwardly within handle 30. A second leg of spring 244 protrudes against trigger 24 and biases trigger 24 outwardly away from handle 30. This serves to return trigger 24 to its original position while trigger axle 200 is held stationary by uni-directional bearing 248. Consequently, contraction of trigger 24 drives dual plunger 22 while release of trigger 24 does not retract the plunger 22.

The uni-directional bearing may be a conventional annular clutch-type component such as, for instance, those which are commercially available from Torrington ®. More specifically, Part No. RC-081208 has been employed in a prototype unit.

A spur gear 250 is also mounted coaxially on trigger axle 200 adjacent trigger 24, and spur gear 250 should be secured to trigger axle 200 by means of a set screw 251 or otherwise. During incremental contraction of trigger 24, spur gear 250 rotates in unison with trigger axle 200.

The balance of the drive assembly 4 is best seen in FIG. 3. A main drive axle 300 is carried directly above the trigger axle 200 within housing 210. Main drive axle 300 may be similarly secured within housing 210 by locking C-rings 304 which engage annular grooves 302 formed around the slightly protruding ends of main drive axle 300. The ends of the main drive axle 300 are carried in the side-walls of housing 210 within two oblong slots 212. Slots 212 provide sufficient vertical clearance to allow a limited degree of upward and downward movement of the main drive axle 300 within housing 210. Three gears are coaxially carried on the main drive axle 300, and these include a first pinion gear 310, a second pinion gear 320, and a main drive gear 330 in between the flanking pinion gears 310 and 320. The first pinion gear 310, second pinion gear 320, and main drive gear 330 are all three secured to main drive axle 300 by means of set screws 311, 331, and 321, respectively, or otherwise. In the preferred embodiment, a tubing spacer 312 is interposed between the first pinion gear 310 and the main drive gear 330 to maintain the proper spacing therebetween.

The main drive gear is engaged by downward positioning of the main drive axle 300 within the slots 212 of housing 210. While engaged, the main drive gear 330 bears against and is driven by the smaller spur gear 250 mounted on trigger axle 200.

The diameter of the main drive gear 330 is larger than the diameter of the spur gear 250 in order to effect a first level of gear reduction. Conversely, the diameter of pinion gears 310 and 320 are smaller than the diameter of the main drive gear 330 in order to effect a second level of gear reduction. Pinion gears 310 and 320 operate directly on the respective plunger shafts 23 and 25.

Dual plunger 22 is carried within housing 210 directly beneath the main axle 300. Opposing plunger shafts 23 and 25 of the dual plunger 22 traverse housing 210 and are carried therein transversely with respect to the trigger axle 200 and main drive axle 300. The upper surface of both plunger shafts 23 and 25 are defined by a rack of parallel teeth. The teeth of plunger shafts 23 and 25 respectively bear against and cooperate with the teeth of pinion gears 310 and 320. Consequently, incremental clockwise angular rotation of pinion gears 310 and 320 results in an incremental axial thrusting of dual plunger 22.

In the preferred embodiment, downward support of dual plunger 22 is provided by a plunger bearing assembly which comprises two parallel bearing axles 420 and 430 which are transversely carried in housing 210 beneath the two plungers 23 and 25. The bearing axles 420 and 430 are spaced on opposing sides of the trigger axle 200 and may likewise be anchored in the side-walls of housing 210 by means of locking C-rings 422 and 432 inserted in annular grooves 421, 431 which are formed around the protruding ends of the respective bearing axles 420 and 430. A pair of plunger bearings 410 is carried on each bearing axle 420 and 430. The plunger bearings 410 are aligned such that each plunger shaft 23 and 25 is borne at two points along its length. The proper alignment of plunger bearings 410 may be maintained by interposing a set of three tubing spacers 723 therebetween. The plunger shafts 23 and 25 ride upon the respective bearings 410 and receive downward support therefrom.

A front support plate 500 is mounted on the front wall of housing 210 to provide additional support. A spring-loaded coupling including a dog 604, dog axle 602, and main spring 606 is mounted within housing 210 and is secured inwardly of support plate 500 in a facing relation with main gear 330. The spring-loaded coupling also includes a mounting block 600 which may be screwed to front support plate 500 through housing 210 (via screws 601). The dog 604 is pivotably mounted on a dog axle 606 within mounting block 600. The spring 606 bears against the back of dog 604 and biases dog 604 downwardly against the teeth of main gear 330. Dog 604 permits clockwise rotation of main gear 330 to thereby effect the dispensing operation. However, the dispensing operation results in an extreme pressure build-up within the twin cylinder epoxy cartridge, and the elastic property of the epoxy imparts a like backward force on dual plunger 22. Dog 604 engages the teeth of the main gear 330 to prevent counterclockwise rotation, thereby preventing backward movement of dual plunger 22.

Figures 5A, 5B, 5C:
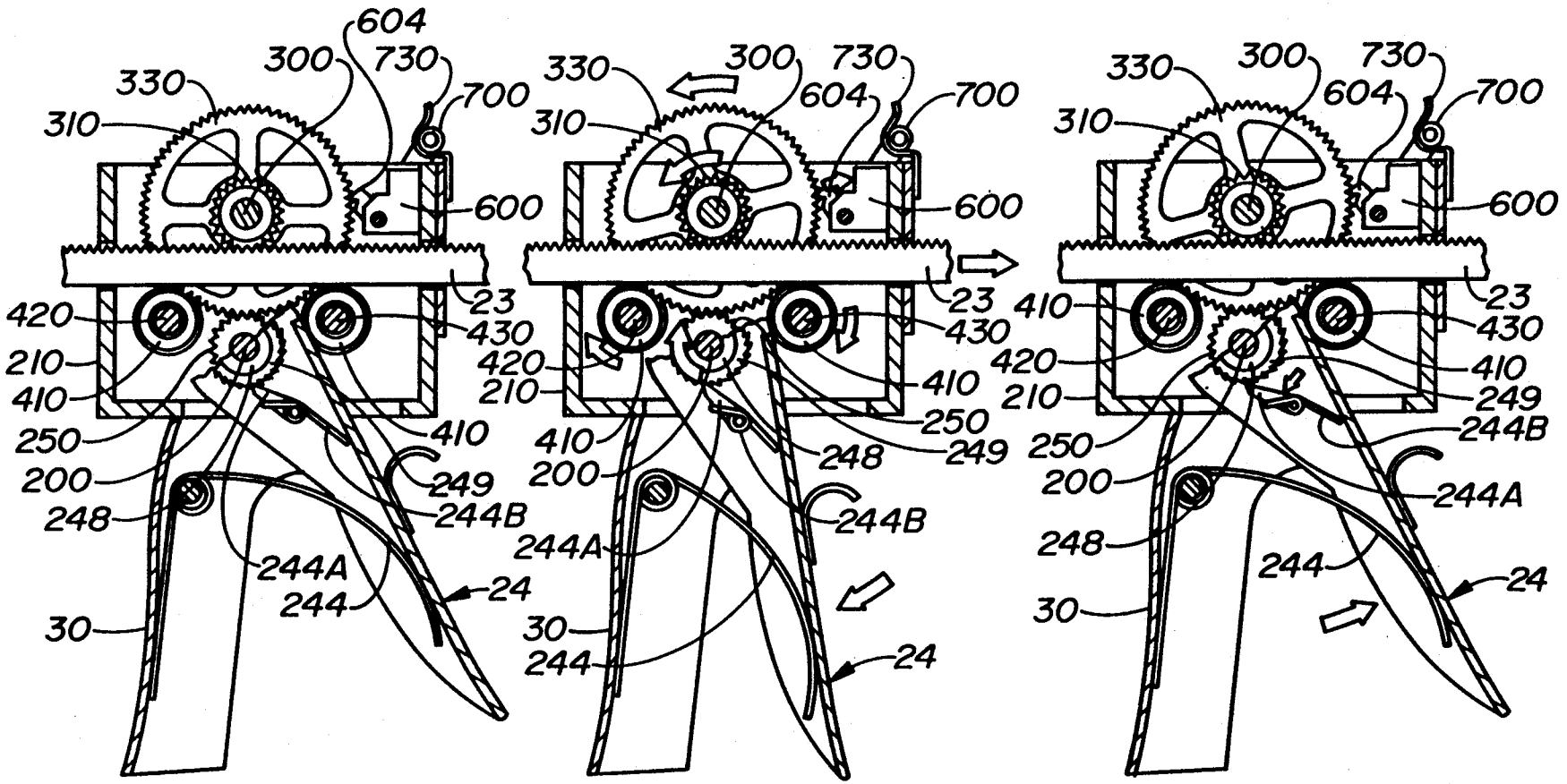
FIGS. 5A–5C are sequential sectional views of the double reduction gear drive with quick release assembly according to the present invention illustrating the operation during contraction and release of the trigger 24.

FIGS. 5A–5C are sequential sectional views showing the operation of the double reduction gear drive 4 according to the present invention during contraction and release of the trigger 24. It is apparent in FIGS. 5A–5C how successive contraction and release of trigger 24 is translated through the two levels of gear reduction to an incremental axial drive of dual plunger 22.

FIG. 5A illustrates the engaged position wherein the main drive gear 330 is downwardly positioned within the slots 212 of housing 210. While engaged, the main drive gear 330 bears against and is driven by the smaller spur gear 250 mounted on trigger axle 200.

Consequently, as shown in FIG. 5B, contraction of trigger 24 causes an incremental clockwise angular rotation of spur gear 250, which in turn imparts an incremental counterclockwise angular rotation to main drive gear 330. The first and second pinion gears 310 and 320 turn in unison with main drive gear 330, and pinion gears 310 and 320 engage the racks of the plunger shafts 23 and 25 to drive the dual plunger 22 forwardly into the epoxy cartridge.

As shown in FIG. 5C, release of trigger 24 disengages the uni-directional bearing 248 and dog 244A overrides the teeth of ratchet gear 249. Hence, the trigger axle 200 remains stationary along with the spur gear 250, main drive gear 330, pinion gears 310 and 320, and dual plunger 22. The dog 604 of the spring-loaded coupling insures that the main drive gear 330 remains stationary (despite any pressure build-up within the twin cylinder epoxy cartridge) by engaging the teeth of the main gear 330 to prevent counterclockwise rotation thereby preventing backward movement of dual plunger 22.

The double reduction gear drive 4 is also provided with an improved quick release feature for disengaging the main gear 330 from the spur gear 250 while simultaneously disengaging the first and second pinion gears 310 and 320 from the racks of the respective plungers 23 and 25.

The quick release feature comprises a pivoting quick release bar 700 which is carried within a pair of hollow cylindrical sleeves 710A and 720A, the sleeves in turn being integrally attached to a left camming member 710 and a right camming member 720, respectively.

Quick release bar 700 protrudes forwardly from housing 210 to facilitate gripping and maneuvering thereof. The left and right sleeves 710A and 720A, respectively, slidably encircle the ends of the quick release bar 700. The camming members 710 and 720 are respectively attached to sleeves 710A and 720A and extend transversely therefrom along parallel planes to embrace the sides of housing 210. The lower lobes of camming members 710 and 720 are provided with holes for pivotal attachment to the respective side-walls of housing 210 and may be conveniently mounted on the trigger axle 200. The upper portion of members 710 and 720 are defined by arcuate camming slots 712 and 722, and the ends of the main axle 300 protrude outwardly through the slots 212 in the side-walls of housing 210 and are carried within the respective camming slots 712 and 722 of camming members 710 and 720. Slots 712 and 722 are contoured so that rearward pivoting of quick release bar 700 (and camming members 710 and 720) operates to bias the main axle 300 upwardly in within slots 212. Similarly, forward pivoting of quick release bar 700 (and camming members 710 and 720) operates to bias the main axle 300 downwardly within slots 212. A resilient catch 730 is attached via screw 731 to the top of the forward wall of housing 210 (in support plate 500) to lock the quick release bar 700 in the forward (engaged) position. Catch 730 is preferably shaped to conform to the rounded quick release bar 700.

Figure 6B:
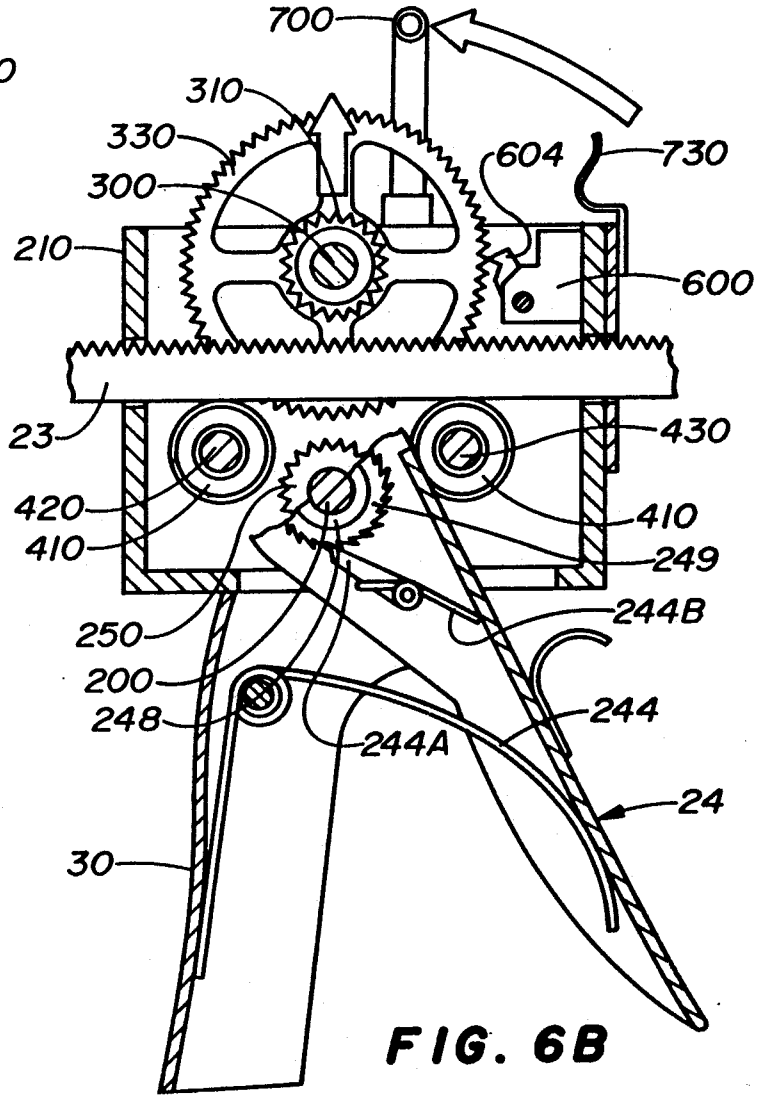
FIGS. 6A and 6B are sequential sectional views of the double reduction gear drive with quick release assembly according to the present invention illustrating the operation of the quick release assembly.
Figure 6A:
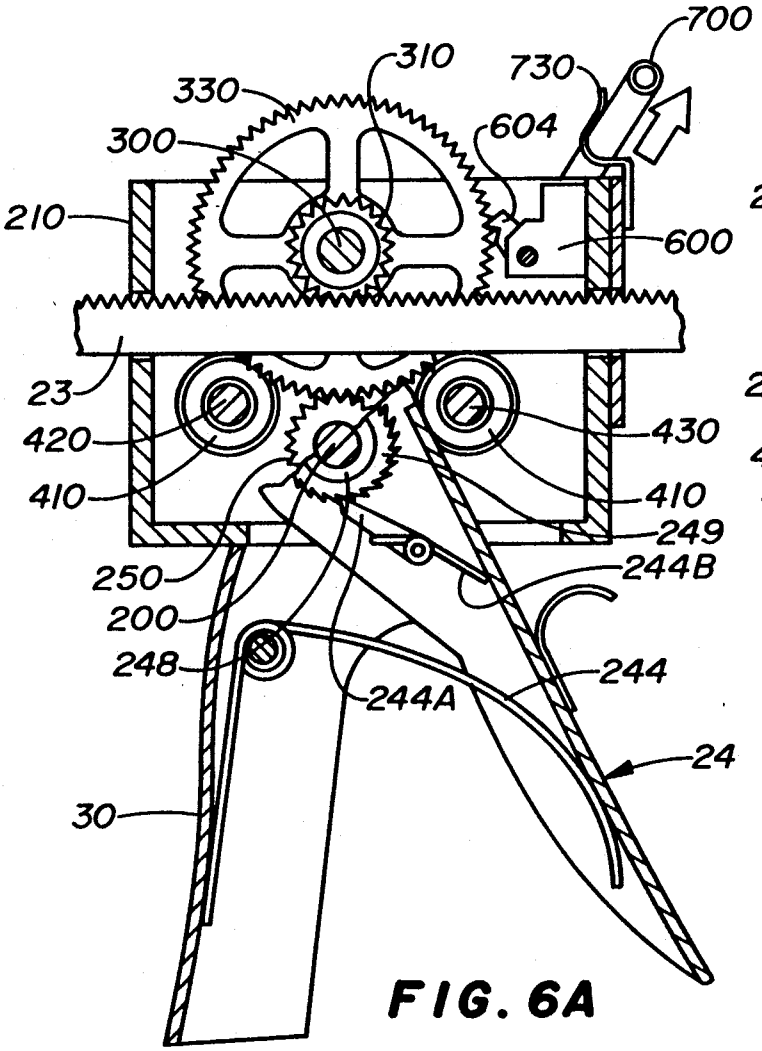

The operation of the quick release feature is illustrated in FIGS. 6A and 6B.

As shown in FIG. 6A, quick release bar 700 is freed from catch 730 by sliding the quick release bar 700 upwardly within sleeves 710A and 720A.

As shown in FIG. 6B, the quick release bar 700 may then be freely pivoted over catch 730 and rearwardly of housing 210. This likewise pivots camming members 710 and 720 which serve to bias the main axle 300 upwardly in within slots 212. Consequently, the main gear 330 is removed from engagement with the spur gear 250, and the pinion gears 310 and 320 are likewise disengaged from the racks of the respective plunger shafts 23 and 25. In the above-described disengaged position, the dual plunger 22 can be manually retracted to allow removal of a spent epoxy cartridge and reloading with a fresh cartridge.

Dispensing can be resumed by pivoting the quick release bar 700 and camming members 710 and 720 forwardly of housing 210. Slots 712 and 722 then bias the main drive axle 300 downwardly within slots 212 thereby reengaging the gears for further thrusting. Quick release bar 700 may be seated in this engaged position by sliding the quick release bar 700 down into camming members 710 and 720 until it is seated in catch 730.

Having now fully set forth the preferred embodiments and certain modifications of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

I claim:

1. A double-reduction drive assembly for a dispensing gun comprising:

an elongate plunger traversing said housing, said plunger being formed with a toothed rack along a length;

a trigger connected to said housing at a pivoting axis, said trigger being manually contractible for driving said plunger;

a double-reduction gear assembly carried in said housing for mechanically converting manual contractions of said trigger into incremental axial movement of said plunger, said double-reduction gear assembly further comprising, a spur gear connected to said trigger and rotatable therewith about said pivoting axis, a main drive gear rotatably carried in said housing, said main drive gear being engagable with said spur gear and driven thereby, and said main drive gear having a larger diameter than said spur gear, and a pinion gear carried in said housing and mounted coaxially with said main drive gear for rotation therewith, said pinion gear having a smaller diameter than said main drive gear, and said pinion gear being engagable with said toothed rack of said plunger to advance said plunger in axial increments.

2. The double-reduction drive according to claim 1 wherein said trigger is carried in said housing on a trigger axle, and said spur gear is mounted coaxially on said trigger axle.

3. The double-reduction drive according to claim 1 further comprising a uni-directional bearing for driving said spur gear in one direction in accordance with contraction of said trigger while maintaining said spur gear stationary during release of said trigger, thereby causing incremental uni-directional axial movement of said plunger in accordance with each contraction and release of said trigger.

4. A double-reduction drive for a twin-cylinder dispensing gun comprising:

a housing;

a dual plunger assembly carried by said housing, said dual plunger assembly further comprising a first plunger shaft and a parallel second plunger shaft both traversing said housing, said first and second plunger shafts each being formed with a toothed rack along their length;

a trigger connected to said housing at a pivoting axis, said trigger being manually contractible for driving said dual plunger assembly;

a double-reduction gear assembly carried in said housing for mechanically converting manual contractions of said trigger into incremental axial movement of said dual plunger assembly, said reduction gear assembly further comprising, a spur gear connected to said trigger and rotatable therewith about said pivoting axis, a main drive gear rotatably carried in said housing, said main drive gear being engagable with said spur gear for driving thereby, and said main drive gear having a larger diameter than said spur gear, and a first pinion gear carried in said housing and mounted coaxially with said main drive gear for rotation therewith, said first pinion gear having a smaller diameter than said main driving gear, and said first pinion gear being engagable with said toothed rack of said first plunger shaft, and a second pinion gear carried in said housing and mounted coaxially with said main drive gear for rotation therewith, said second pinion gear having a diameter equal to the diameter of said first pinion gear, and said second pinion gear being engagable with said toothed rack of said second plunger shaft;

whereby contraction of said trigger rotates said spur gear, thereby driving said main drive gear and first and second pinion gears and in turn driving the respective plunger shafts in an equal axial increment.

5. The double-reduction drive according to claim 4 wherein said first pinion gear is mounted coaxially on one side of said main drive gear, and said second pinion gear is mounted coaxially on another side of said main drive gear.

6. The double-reduction drive according to claim 4 further comprising a uni-directional bearing for driving said spur gear in one direction in accordance with contraction of said trigger while maintaining said spur gear stationary during release of said trigger, thereby causing incremental uni-directional axial movement of said first and second plunger shafts in accordance with each contraction and release of said trigger.

7. The double-reduction drive according to claim 6 wherein said trigger is carried in said housing on a trigger axle, and said spur gear is mounted coaxially on said trigger axle.

8. A quick-release drive for a dispensing gun comprising:

a housing having opposing side-walls;

an elongate plunger traversing said housing, said plunger being formed with a toothed rack along a length;

a trigger pivotally connected to said housing and manually contractible for driving said plunger;

a gear assembly carried in said housing for mechanically converting manual contractions of said trigger into incremental axial movement of said plunger, said gear assembly further comprising, a spur gear connected to said trigger and pivotable therewith, a plunger drive assembly including a main drive axle rotatably mounted in said housing, said main drive axle being carried at the ends by notches formed in the opposing side-walls of said housing, said notches being dimensioned to allow a degree of vertical movement of said main drive axle relative to said housing, said plunger drive assembly being selectively engagable with said spur gear and driven thereby when engaged to advance said plunger in axial increments; and a quick-release assembly means for manually biasing said main drive axle up and down within the notches in the side walls of said housing, thereby allowing selective engagement and disengagement said plunger drive assembly and said spur gear.

9. The double-reduction drive according to claim 8 wherein said quick release assembly means further comprises a first camming member having one end pivotally mounted to said housing and another end defined by an arcuate camming slot for embracing said main drive axle, whereby pivoting of said first camming member biases said main drive axle upward within the notches in the side-walls of said housing to disengage the plunger drive assembly and spur gear.

10. The double-reduction drive according to claim 9 wherein said quick release assembly means further comprises a second camming member, and a release bar attached between said camming members for allowing manipulation thereof, said camming members each having one end pivotally mounted to a respective side-wall of said housing and another end defined by an arcuate camming slot for embracing a respective end of said main drive axle, whereby pivoting of said camming members by manipulation of said release bar biases said main drive axle upward within the notches in the side-walls of said housing to disengage the plunger drive assembly and spur gear.

11. The double-reduction drive according to claim 10 wherein said quick release assembly means comprises a resilient catch mounted on said housing for maintaining said release bar in a first position in which said main drive axle is biased downward within the notches in the side-walls of said housing to engage the plunger drive assembly and spur gear.

12. The double-reduction drive according to claim 11 wherein said release bar is substantially U-shaped and is slidably carried between said first and second camming members such that said release bar may be extracted from said camming members over said resilient catch to allow pivoting of said release bar and camming members to a second position in which said main drive axle is biased upwardly within the notches in the side-walls of said housing to disengage said plunger drive assembly and spur gear.

13. A double-reduction drive for a dispensing gun comprising:

a housing having opposing side-walls;

an elongate plunger traversing said housing, said plunger being formed with a toothed rack along a length;

a trigger pivotally connected to said housing and manually contractible for driving said plunger;

a double-reduction gear assembly carried in said housing for mechanically converting manual contractions of said trigger into incremental axial movement of said plunger, said reduction gear assembly further comprising, a spur gear connected to said trigger and pivotable therewith, a main drive axle rotatably mounted in said housing, said main drive axle being carried at the ends by notches formed in the opposing side-walls of said housing, said notches being dimensioned to allow a degree of vertical movement of said main drive axle, a main drive gear rotatably mounted on said main drive axle in said housing, said main drive gear being selectively engagable with said spur gear and driven thereby when engaged, and said main drive gear having a larger diameter than said spur gear, and a pinion gear carried in said housing and mounted coaxially with said main drive gear for rotation therewith, said pinion gear having a smaller diameter than said main driving gear, and said pinion gear being engaged with said toothed rack of said plunger to advance said plunger in axial increments; and a quick-release assembly means for selectively engaging and disengaging said main drive gear and said spur gear.

14. The double-reduction drive according to claim 13 wherein said quick-release assembly means biases said main drive axle upward within the notches in the opposing side-walls of said housing to disengage the main drive gear and spur gear.

15. The double-reduction drive according to claim 14 wherein said quick release assembly means further comprises a first camming member having one end pivotally mounted to said housing and another end defined by an arcuate camming slot for embracing said main drive axle, whereby pivoting of said first camming member biases said main drive axle upward within the notches in the side-walls of said housing to disengage the main drive gear and spur gear.

16. The double-reduction drive according to claim i5 wherein said quick release assembly means further comprises a second camming member, and a release bar carried between said camming member, said camming members having one end pivotally mounted to a respective side-wall of said housing and another end defined by an arcuate camming slot for embracing a respective end of said main drive axle, whereby pivoting of said camming members by manipulation of said release bar biases said main drive axle upward within the notches in the side-walls of said housing to disengage the main drive gear and spur gear.

17. The double-reduction drive according to claim 16 wherein said quick release assembly further comprises a resilient catch mounted on said housing for maintaining said release bar in a first position in which said main drive axle is biased downward within the notches in the side-walls of said housing to engage the main drive gear and spur gear.

18. The doable-reduction drive according to claim 17 wherein said release bar is substantially U-shaped and is retractably carried between said first and second camming member, whereby said release bar may be extracted from said camming members over said resilient catch to allow pivoting of said release bar and camming members to a second position in which said main drive axle is biased upward within the notches in the side-walls of said housing to disengage the main drive gear and spur gear.

19. A double-reduction drive for a twin-cylinder epoxy dispensing gun comprising:

a housing;

a dual plunger assembly by said housing, said dual plunger assembly further comprising a first plunger shaft and a parallel second plunger shaft both traversing said housing, said first and second plunger shafts each being formed with a toothed rack along their length;

a trigger pivotally connected to said housing and manually contractible for driving said dual plunger assembly;

a double-reduction gear assembly carried in said housing for mechanically converting manual contractions of said trigger into incremental axial movement of said dual plunger assembly, said reduction gear assembly further comprising, a spur gear coupled to said trigger and pivotable therewith, a main drive axle rotatably mounted in said housing, said main drive axle being carried at the ends within notches formed in the opposing side-walls of said housing, said notches being dimensioned to allow a degrees of vertical movement of said main drive axle, a main drive gear rotatably mounted on said main drive axle in said housing, said main drive gear being selectively engagable with said spur gear and driven thereby when engaged, and said main drive gear having a larger diameter than said spur gear, and a first pinion gear carried in said housing and mounted coaxially with said main drive gear for rotation therewith, said first pinion gear having a smaller diameter than said main driving gear, and said first pinion gear being engaged with said toothed rack of said first plunger shaft; and a second pinion gear carried in said housing and mounted coaxially with said main drive gear for rotation therewith, said second pinion gear having a diameter equal to the diameter of said first pinion gear, and said second pinion gear being engaged with said toothed rack of said second plunger shaft; and a quick-release assembly means for selectively biasing the main drive axle upward and downward within the notches in the opposing side-walls of said housing, thereby respectively disengaging and engaging said main drive gear from said spur gear and said first and second pinion gears from the respective racks of said first and second plunger shafts;

whereby contraction of said trigger rotates said spur gear and, when said main drive gear is engaged, drives said main gear and first and second pinion gears in turn driving the respective plunger shafts in an equal axial increment.

20. The double-reduction drive according to claim 19 wherein said first pinion gear is mounted coaxially on one side of said main drive gear, and said second pinion gear is mounted coaxially on another side of said main drive gear.

21. The double-reduction drive according to claim 20 wherein said quick-release assembly means biases said main drive axle upward within the notches in the opposing side-walls of said housing to disengage the main drive gear and spur gear.

22. The double-reduction drive according to claim 21 wherein said quick release assembly means further comprises a first camming member having one end pivotally mounted to said housing and another end defined by an arcuate camming slot for embracing said main drive axle, whereby pivoting of said first camming member biases said main drive axle upward within the notches in the side-walls of said housing to disengage the main drive gear and spur gear.

23. The double-reduction drive according to claim 22 wherein said quick release assembly means further comprises a second camming member, and a release bar carried between said camming members, said camming members each having one end pivotally mounted to a respective side-wall of said housing and another end defined by an arcuate camming slot for embracing a respective end of said main drive axle, whereby pivoting of said camming members by manipulation of said release bar biases said main drive axle upward within the notches in the side-walls of said housing to disengage the main drive gear and spur gear.

24. The double-reduction drive according to claim 23 wherein said quick release assembly means further comprises a resilient catch mounted on said housing for maintaining said release bar in a first position in which said main drive axle is biased downward within the notches in the side-walls of said housing to engage the main drive gear and spur gear.

25. The double-reduction drive according to claim 24 wherein said release bar is substantially U-shaped and is retractably carried between said first and second camming members, whereby said release bar may be extracted from said camming members over said resilient catch to allow pivoting of said release bar and camming members to a second position in which said main drive axle is biased upward within the notches in the side-walls of said housing to disengage the main drive gear and spur gear, thereby allowing retraction of said dual plunger assembly.

* * * * *